US009557051B2

(12) United States Patent
Chen

(10) Patent No.: US 9,557,051 B2
(45) Date of Patent: Jan. 31, 2017

(54) VORTEX FLAME DEVICE CAPABLE OF BEING MANUALLY IGNITED SAFELY

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 463 days.

(21) Appl. No.: 14/106,934

(22) Filed: Dec. 16, 2013

(65) Prior Publication Data

US 2015/0167963 A1 Jun. 18, 2015

(51) Int. Cl.
*F23C 7/00* (2006.01)
*F23D 14/04* (2006.01)
*F23D 14/28* (2006.01)

(52) U.S. Cl.
CPC ..... *F23C 7/002* (2013.01); *F23D 14/04* (2013.01); *F23D 14/28* (2013.01)

(58) Field of Classification Search
CPC ..... F23C 7/004; F23C 7/006; F23C 7/002; F23C 7/02; F23D 14/24; F23D 14/10; F23D 14/06; F23D 14/28; F23R 3/14
See application file for complete search history.

(56) References Cited

U.S. PATENT DOCUMENTS 7,097,448 B2 8/2006 Chesney
D621,873 S 8/2010 Tsai
2007/0160944 A1* 7/2007 Knight ..... F23Q 3/006 431/264
2007/0292810 A1* 12/2007 Maiello ..... F23N 1/002 431/59
2010/0154779 A1* 6/2010 Andors ..... F24C 3/006 126/512
2012/0178035 A1* 7/2012 Chen ..... F23D 5/04 431/354
2013/0011800 A1 1/2013 Chen
2013/0252188 A1* 9/2013 Chen ..... F23D 14/06 431/353

FOREIGN PATENT DOCUMENTS

GB 1414813 A * 11/1975 ..... F23C 7/006

* cited by examiner

*Primary Examiner* — Jason Lau
(74) *Attorney, Agent, or Firm* — Alan D. Kamrath; Kamrath IP Lawfirm, P.A.

(57) ABSTRACT

A vortex flame device includes a flow guiding mechanism integrated from two half flow guiding mechanisms and with which a fuel reservoir is adapted to connect. Each half flow guiding mechanism includes a wall. The walls are engaged together in a manner movable relative to each other, and each includes a plurality of vanes mounted thereon. Two adjacent vanes include a spiral air passage formed therebetween and in communication with the channel. The two half flow guiding mechanisms selectively change to a first position including a gap between free ends thereof and a second position with the free ends thereof joined. Further, a combustion head is disposed in the channel and has at least one outlet hole that fuel of the connected fuel reservoir flows through. Further, a shield is disposed above the flow guiding mechanism.

13 Claims, 8 Drawing Sheets

VORTEX FLAME DEVICE CAPABLE OF BEING MANUALLY IGNITED SAFELY

BACKGROUND OF THE INVENTION

1. Field of the Invention

The present invention relates to a vortex flame device and, particularly, to a vortex flame device that can be manually ignited safely.

2. Description of the Related Art

U.S. Pat. No. 7,097,448 discloses a vortex type gas lamp for producing an upwardly directed vortex flame inside a surrounding and confined boundary of a rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. The gas lamp further includes a shield including first and second axially extending sections structurally attached to the base in a fluid sealing relationship. The first and second sections are substantially identical and transparent to light, and each includes an impermeable wall having an arcuate inner surface and an arcuate outer surface. Furthermore, each of the first and second sections has first and second edges extended axially. The gas lamp yet further includes the first and second walls alternately overlapping one another. The first and second walls are adjacent to their edges and are spaced from one another to form tangentially directed ports, thereby forming an axially extending mixing chamber open at its side only through the ports. Furthermore, the first and second sections are arranged so that at the base they surround the entry of combustible gas, with air for combustion received only through the ports. Whereby, the combustion of the gas results in a flame spaced from the inner surfaces, and the peripheral body of air is devoid of gas entering through the ports. Generally, if no air is supplied for combustion, a flame will extinguish. Unfortunately, it is not easy to prevent excess air from entering the chamber through the ports and to create a stable swirling flame during combustion since the ports are directly open to air. If the device is placed under an environment with wind, the height and the swirling pattern of the flame are greatly disturbed by excess airflow through the ports due to wind. Notwithstanding, the base of the chamber is also heated during combustion, and if there is not enough airflow through the base to provide cooling, the top surface of the base can be very hot and not safe to touch. Another problem is that an accumulation of the combustible gas can be found near the bottom of the gas lamp. Therefore, when a user ignites the gas lamp manually, he or she is likely to suffer burns in a flash fire. In this case, a continuum ignition system and a piezo valve are used to avoid the danger. However, the system and the valve add to the cost of the gas lamp.

U.S. Design Pat. No. 621,873 discloses a fire tornado lamp including a base and a shield. The base includes a plurality of ports disposed circumferentially. The shield is transparent to light and hollow and includes a passage extended therein. The base and the shield are connected to each other. Each port extends radially with respect to and is in communication with the passage defined in the shield. Each port is configured so that it induces air into the passage in a direction substantially tangential to a circumference of the passage. Likewise, it is not easy to preclude excess air from entering through the ports, and the flame is susceptible to wind. Also, the guided airflow for combustion and for cooling can only enter the chamber through the ports above the bottom of the burning flame at an angle perpendicular to the flame direction. This configuration can generate a swift swirling flame and can induce strong convection during combustion, but it is difficult to control the swirling speed and the pattern of flame. The base of the device can be very hot. A problem that an accumulation of the combustible gas found near the bottom of the lamp also happens here. This is because the lamp does not provide an open region to prevent this problem, too.

The present invention is, therefore, intended to obviate or at least alleviate the problems encountered in the prior art.

SUMMARY OF THE INVENTION

According to the present invention, a vortex flame device capable of being manually ignited safely includes a flow guiding mechanism integrated from two half flow guiding mechanisms and with which a fuel reservoir is adapted to connect. Each half flow guiding mechanism includes a wall. The walls are engaged together in a manner movable relative to each other, and each includes a plurality of vanes mounted thereon. The plurality of vanes is disposed one after another along a circumference of a channel. The two half flow guiding mechanisms jointly delimit the channel. Two adjacent vanes include a spiral air passage formed therebetween and in communication with the channel. The two half flow guiding mechanisms selectively change to a first position including a gap between free ends thereof and a second position where the free ends thereof are joined. Further, a combustion head is disposed in the channel and has at least one outlet hole that fuel of the connected fuel reservoir flows through. Further, a hollow and transparent shield is disposed above the flow guiding mechanism. The shield delimits a space in communication with the channel and the outlet hole.

The two half flow guiding mechanisms are in the first position for safe manual ignition for a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide a vortex flame device that a user can interact to adjust the size of a vortex flame thereof.

Other objects, advantages, and new features of the present invention will become apparent from the following detailed description of the invention when considered in conjunction with the accompanied drawings.

DETAILED DESCRIPTION OF THE INVENTION

Figure 1:
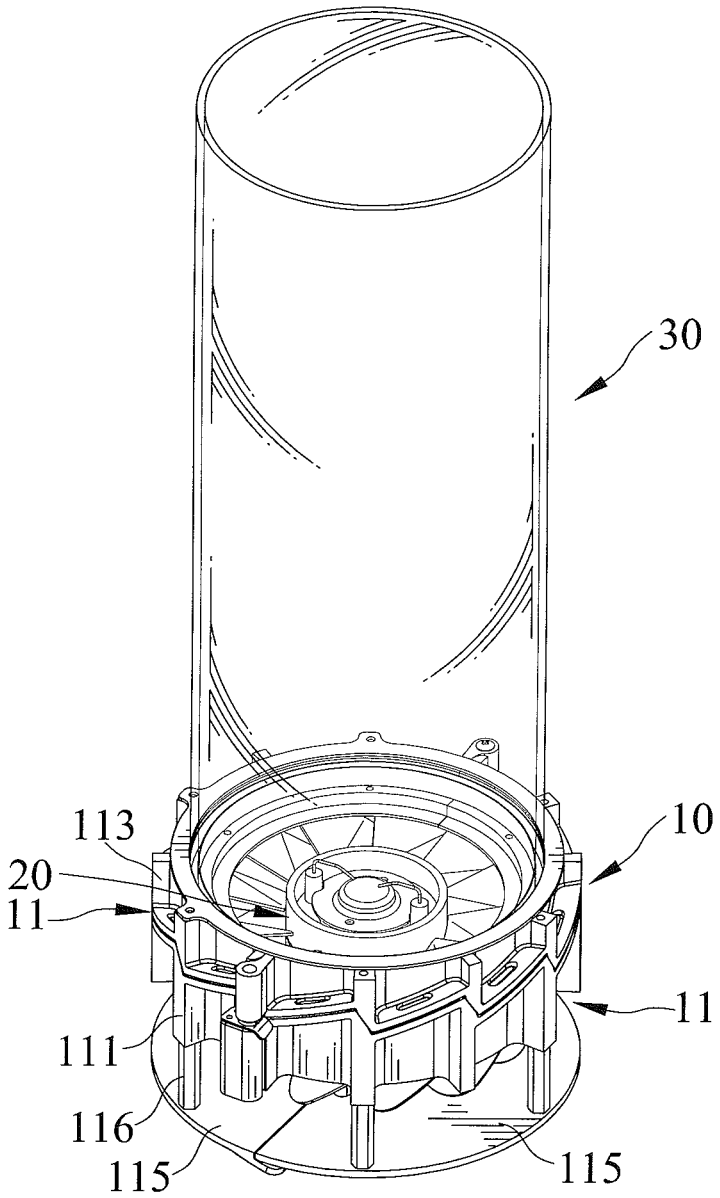
FIG. 1 is a perspective view of a vortex flame device capable of being manually ignited safely in accordance with the present invention.
Figure 2:
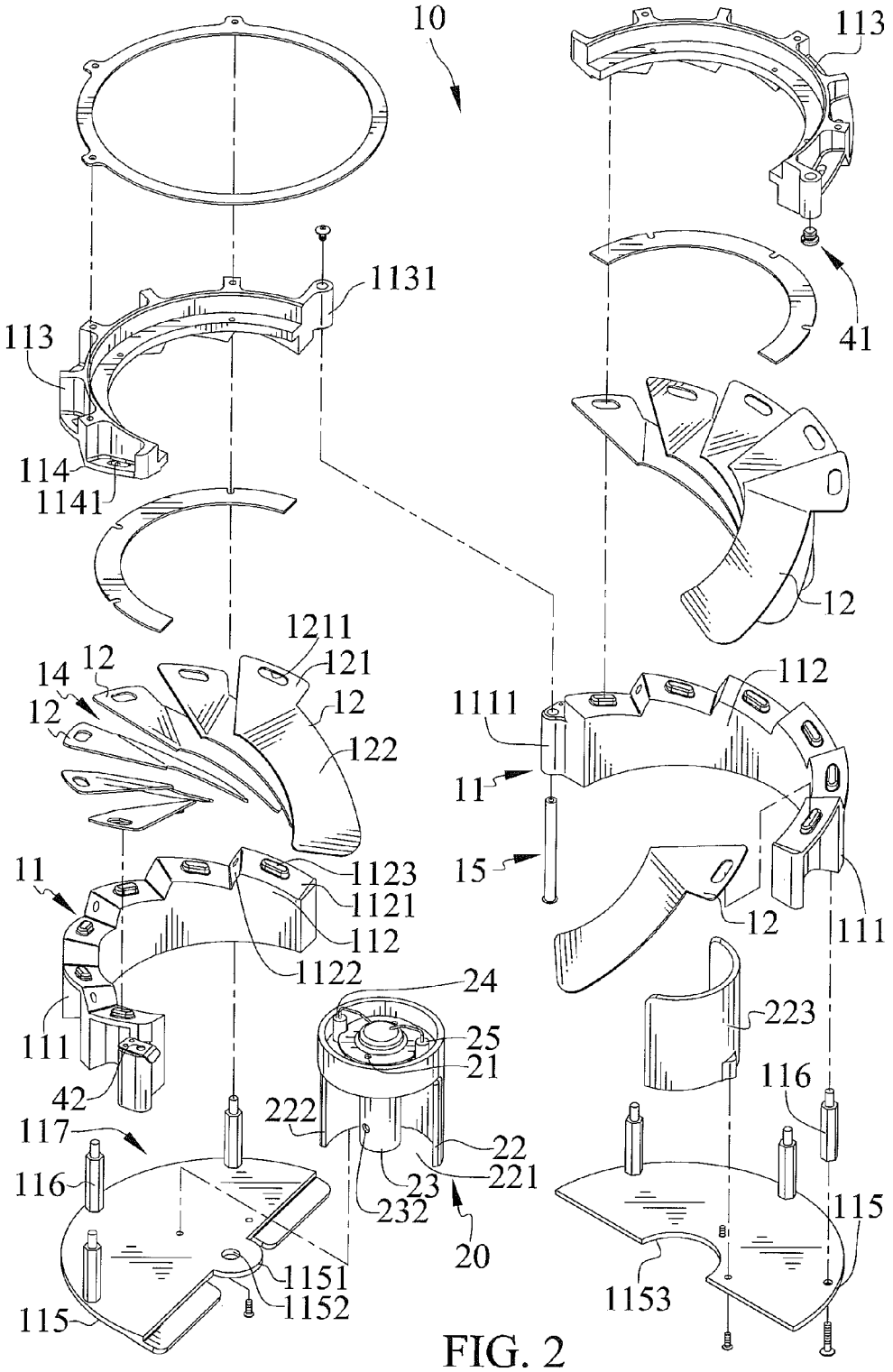
FIG. 2 is an exploded perspective view of the vortex flame device of FIG. 1.
Figure 3:
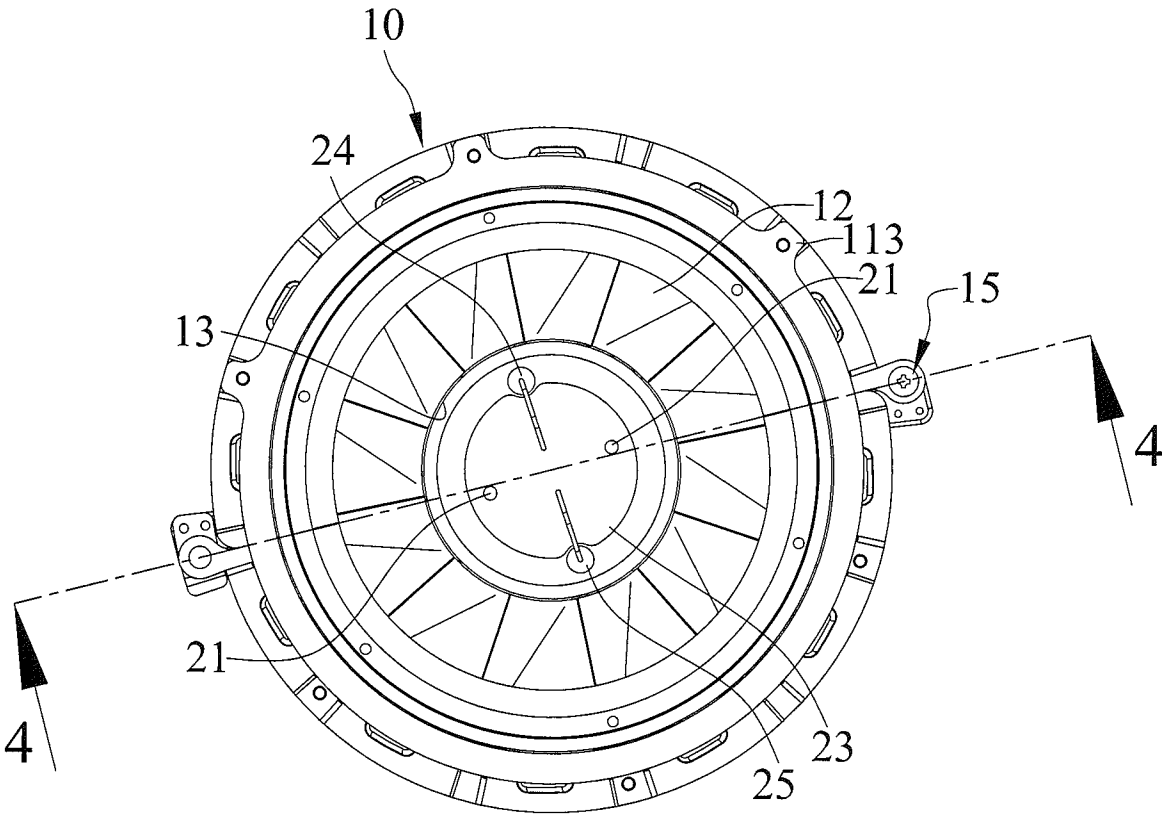
FIG. 3 is a top view of the vortex flame device of FIG. 1.
Figure 4:
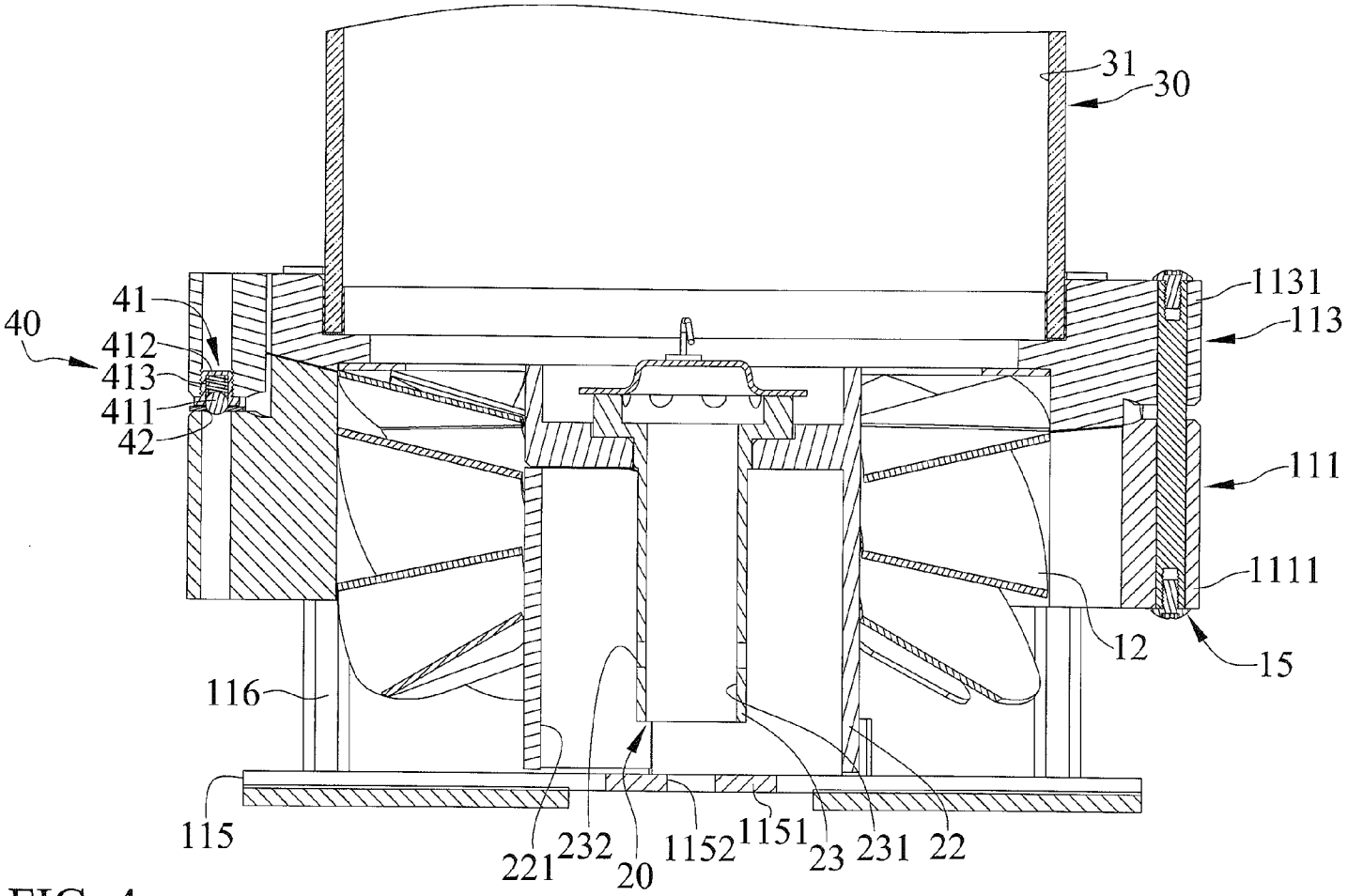
FIG. 4 is a cross-sectional view taken along line 4-4 of FIG. 3.

FIGS. 1 through 8 show a vortex flame device capable of being manually ignited safely in accordance with the present invention and including a flow guiding mechanism 10, a combustion head 20, and a shield 30.

The flow guiding mechanism 10 is integrated from two half flow guiding mechanisms and with which a fuel reservoir 50 is adapted to connect. The two half flow guiding mechanisms each include a wall 11. The walls 11 of the two half flow guiding mechanisms are engaged together in a manner movable relative to each other. The walls 11 of the two half flow guiding mechanisms are pivotally engaged with each other. The walls 11 of the two half flow guiding mechanisms include a pivot 15 engaged therebetween. Therefore, the walls 11 of the two half flow guiding mechanisms are pivotal relative to each other with respect to the pivot 15. The pivot 15 inserts through first and second connecting extensions 1111 and 1131 extending respectively from the walls of the two half flow guiding mechanisms.

Furthermore, the wall 11 of each of the two half flow guiding mechanism includes a plurality of vanes 12 mounted thereon. The plurality of vanes 12 is disposed one after another along a circumference of a channel 13. The two half flow guiding mechanisms jointly delimit the channel 13. Two adjacent vanes 12 include a spiral air passage 14 formed therebetween and in communication with the channel 13.

Each of the two half flow guiding mechanisms includes a first base member 111 and a second base member 113 joined to the first base member 111. The first base member 111 has a first engaging end 112, and the second base member 113 has a second engaging end 114 engaging with the first engaging end 112. The first engaging end 112 forms a plurality of first ridges each including first and second edges 1121 and 1122 and an apex defined therebetween, and the second engaging end 114 forms a plurality of second ridges each including third and fourth edges and an apex defined therebetween respectively. The first and second edges 1121 and 1122 of one of the plurality of first ridges correspondingly face the third and fourth edges of one of the plurality of second ridges. The first and second edges 1121 and 1122 of one of the plurality of first ridges have an included angle of greater than 90 degrees, and the third and fourth edges of one of the plurality of second ridges have an included angle of greater than 90 degrees.

Each of the plurality of vanes 12 has a first extension 121 secured between the first edge 1121 of one of the plurality of first ridges and the third edge of one of the plurality of second ridges and a second extension 122 extending from the first extension 121, and the air passage 14 between two adjacent vanes 12 are delimited by the second extensions 122 thereof. Each of the two half flow guiding mechanisms includes the plurality of vanes 12 held securely between the first and second base members 111 and 113 with a plurality of joints 1123 which insert through the first extensions 121 of the plurality of vanes 12 and fixed to the plurality of securing sections 1141. The plurality of securing sections 1141 is formed on the second base member 113 and the plurality of joints 1123 extends from the first base member 111, respectively. The plurality of securing sections 1141 defines a plurality of apertures and the plurality of joints 1123 defines a plurality of projections, respectively, but not limiting. The plurality of vanes 12 includes a plurality of cavities 1211 through which the plurality of joints 1123 is inserted. Therefore, the plurality of joints 1123 insert through the plurality of vanes 12.

Each of the plurality of vanes 12 includes the second extension 122 extending from the first extension 121 obliquely, with the first and second extensions 121 and 122 having an included angle of greater than 90 degrees.

Each of the two half flow guiding mechanisms includes a pedestal bearing an end of the wall 11. The pedestal includes a base 115 and a plurality of support columns 116 disposed on the base 115, and two adjacent support columns 116 include an ventilation region 117 in between. One of the two half flow guiding mechanisms includes the base 115 of the pedestal defining a first embedding area 1151, and the other of the two half flow guiding mechanisms includes the base 115 of the pedestal defining a second embedding area 1153 respectively. The two half flow mechanisms in the second position include the first and second embedding areas 1151 and 1153 embedded with each other. The first embedding area 1151 defines an extension, and the second embedding area 1153 defines a recess. Moreover, one of the two half flow guiding mechanisms includes the base 115 of the pedestal including a through hole 1152 receiving and allowing insertion of a connecting head 51 of the connected fuel reservoir 50.

The combustion head 20 is disposed in the channel 13 and has at least one outlet hole 21 that fuel of the connected fuel reservoir 50 flows through. The combustion head 20 defines a receiving end 22 delimiting a hollow area 221 and includes an adapter 23 for connecting with a connecting head 51 of the connected fuel reservoir 50 extending in the hollow area of the receiving end 22. The adapter 23 includes a cavity 231 in which the connecting head 51 of the connected fuel reservoir 50 is received and a bore 232 in fluid communication with the hollow area 221. The outlet hole 21 is in fluid communication with the cavity 231. The cavity 231 and the bore 232 extend through the adapter 23. The cavity 231 is delimited by a periphery of the adapter 23, and the bore 232 extends through the periphery of the adapter 23.

The receiving end 22 of the combustion head 20 defines a first peripheral edge 222 on one of the two half flow guiding mechanism and a second peripheral edge 223 on the other of the two half flow guiding mechanism. In the embodiment, the first and second peripheral edges 222 and 223 are arcuate, and the receiving end 22 has a circular periphery when the first and second peripheral edges 222 and 223 are incorporated.

The combustion head 20 includes first and second plugs 24 and 25 adapted to be replaced by an electric ignition system or a thermal sensor.

The shield 30 is hollow and transparent. The shield is disposed above the flow guiding mechanism 10. The shield 30 delimits a space 31 in communication with the channel 13 and the outlet hole 21.

Further, a lock mechanism 40 engages between the walls 11 of the two half flow guiding mechanisms. The lock mechanism 40 is in a first position that the walls 11 of the two half flow guiding mechanisms are movable relative to each other and a second position that the walls 11 of the two half flow guiding mechanisms are not movable with respect to each other. The lock mechanism 40 includes a hole 42 in one of the two half flow guiding mechanisms and a detent 41 mounted on the other of the two half flow guiding mechanisms. The locking mechanism 40 in the first position includes the detent 41 including a catch 412 retained in the hole 42. The locking mechanism 40 in the second position includes the catch 412 disengaged from the hole 42. The catch 412 is engaged with and biased by a biasing member 413. The lock mechanism 40 includes a housing 411 receiving the catch 412 and the biasing member 413. The biasing member 413 has one end abutted against the catch 412 and another end abutted against the housing 411. In the embodiment, the catch 412 is in the form of a ball.

The two half flow guiding mechanisms selectively change to a first position including a gap between free ends thereof and a second position with the free ends thereof joined. The gap is connected to and in communication with the channel 13. In a case that the gap does not exist, the channel 13 has an enclosed periphery. In a case that the gap exists, the channel 13 has an unclosed periphery.

Figure 5:
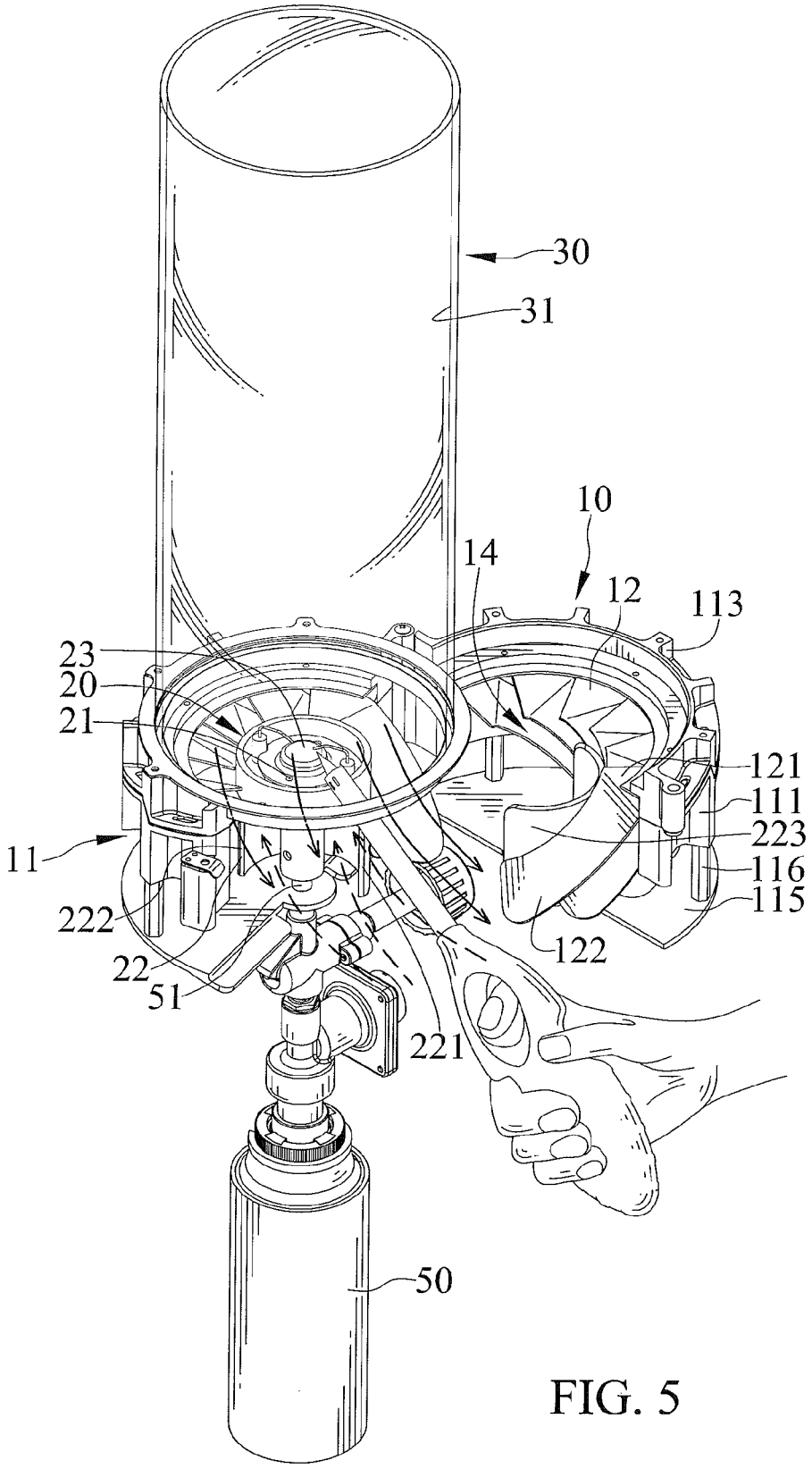
FIG. 5 is a perspective view showing the vortex flame device of FIG. 1 in a position for safe manual ignition for a user.
Figure 6:
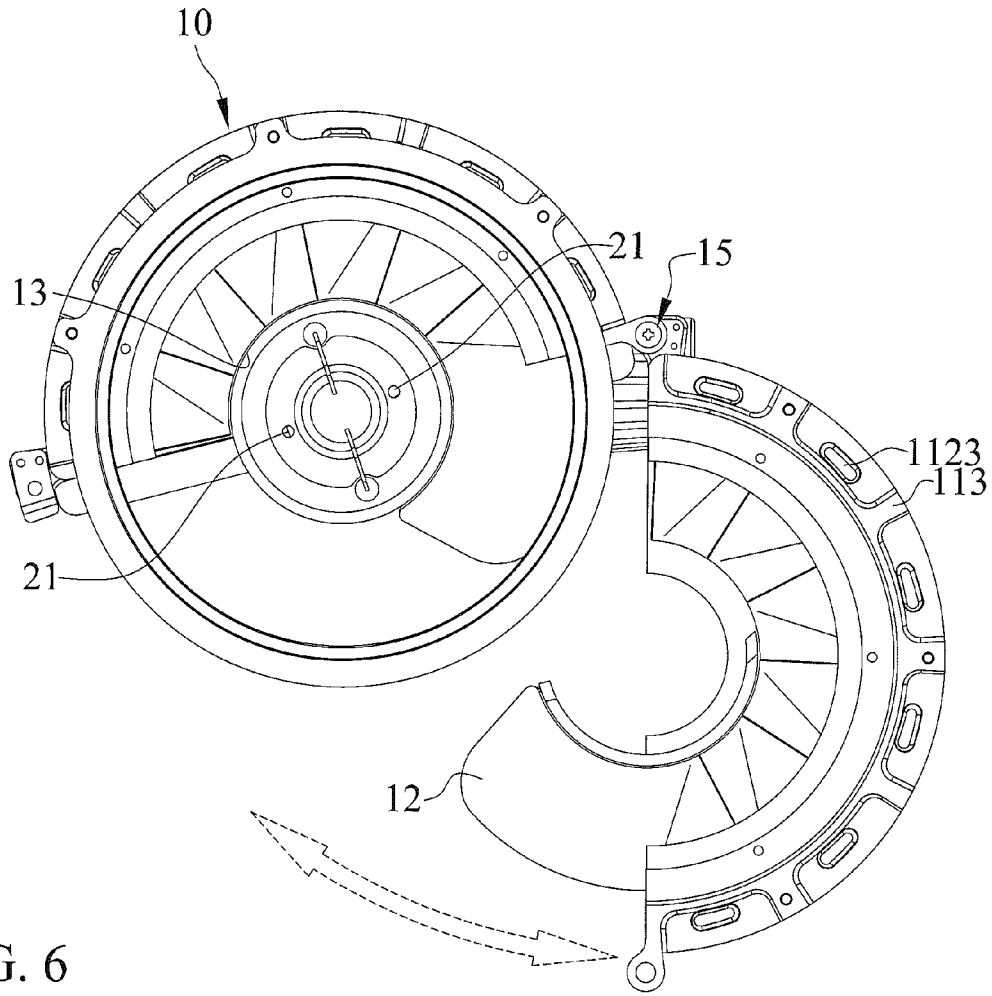
FIG. 6 is a top view showing the vortex flame device in the position shown in FIG. 5.
Figure 7:
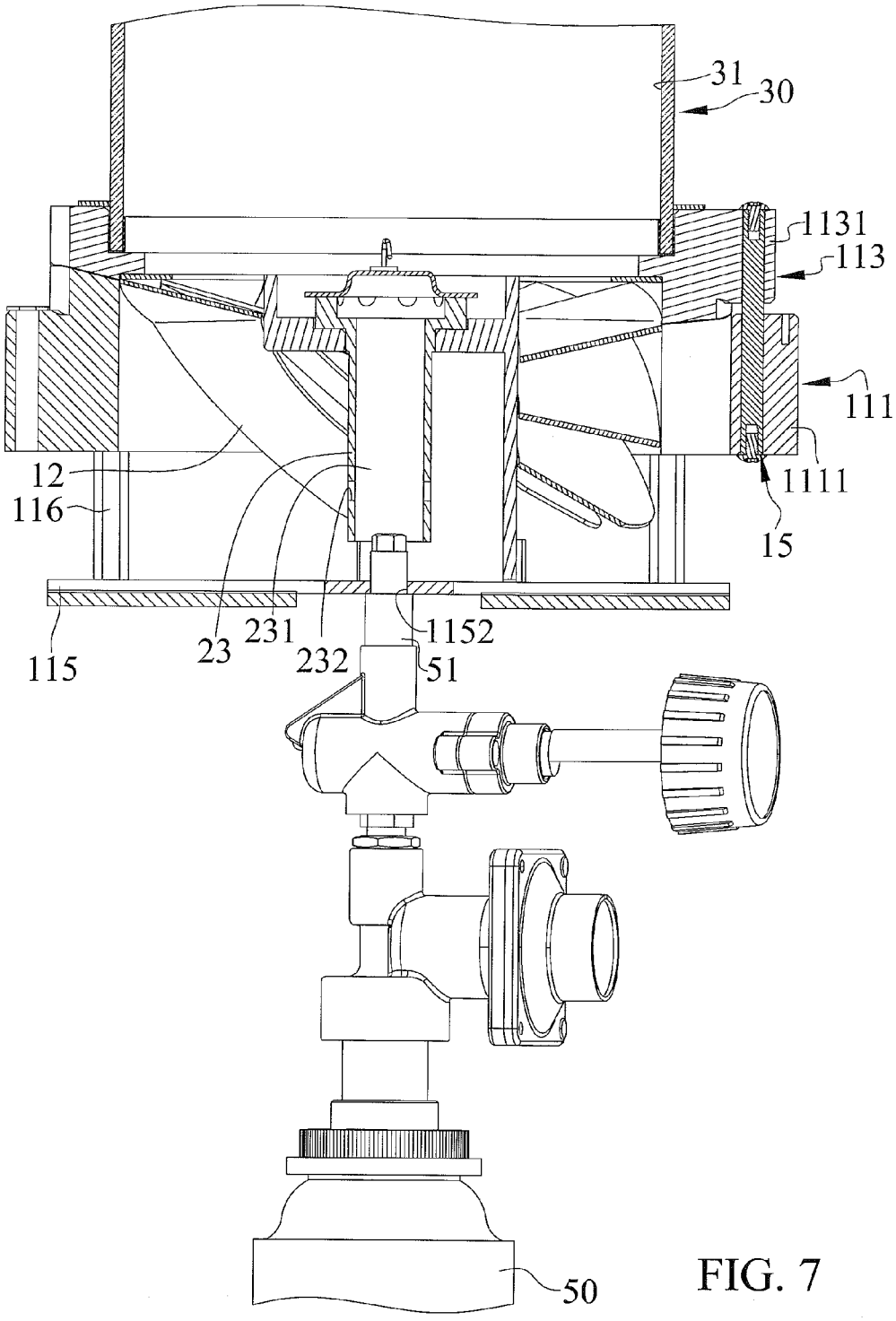
FIG. 7 is a partial cross-sectional view of the vortex flame shown in FIG. 5
Figure 8:
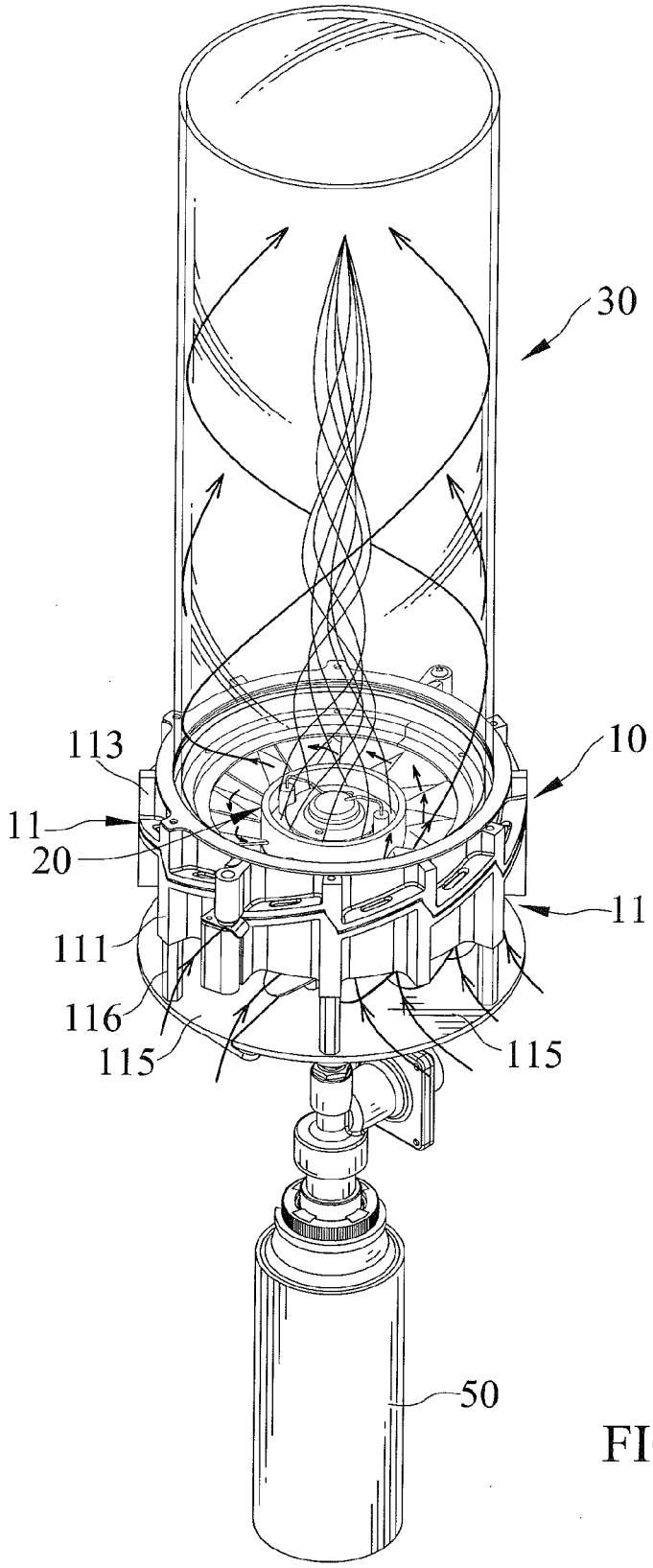
FIG. 8 is a perspective view showing the vortex flame device of FIG. 1 in a position to produce a vortex flame.

The two half flow guiding mechanisms are in the first position for safe manual ignition for a user. FIG. 5 shows that when the two half flow guiding mechanisms are in the first position, the gap prevents an accumulation of the combustible gas, so a user will not suffer burns in a flash fire when igniting the vortex flame device manually. In addition, the gap allows the user an easy access for igniting the vortex flame device.

In view of the forgoing, the vortex flame device resolves the problems of the set forth devices. The flow guiding mechanism 10 includes two half flow guiding mechanisms which are movable relative to each other in a position for safe manual ignition for a user. Furthermore, the stack effect occurs in the vortex flame device, and the negative pressure due to the stack effect in the shield 30 can induce the outside air into the vortex flame device. The Coanda effect also occurs in the vortex flame device, with the outside air in the vortex flame device guided by the plurality of vanes 12 to flow spirally in the shield 30 and to attach to an inner peripheral wall of the shield 30. With the flow guiding mechanism 10, the Coanda effect in the vortex flame device is effective, so a flame of the vortex flame device is stable and smooth.

While the specific embodiments have been illustrated and described, numerous modifications come to mind without significantly departing from the spirit of invention, and the scope of invention is only limited by the scope of the accompanying claims.

What is claimed is:

1. A vortex flame device capable of being manually ignited safely comprising:

a flow guiding mechanism integrated from two half flow guiding mechanisms and with which a fuel reservoir is adapted to connect, with each half flow guiding mechanism including a wall, with the walls of the two half flow guiding mechanisms engaged together in a manner movable relative to each other, with each wall including a plurality of vanes mounted thereon, with the plurality of vanes disposed one after another along a circumference of a channel, with the two half flow guiding mechanisms jointly delimiting the channel, with two adjacent vanes of the plurality of vanes including a spiral air passage formed therebetween and in communication with the channel, with the two half flow guiding mechanisms selectively changing to a first position including a gap between free ends thereof and a second position with the free ends thereof joined;

a combustion head disposed in the channel and having at least one outlet hole that fuel of the connected fuel reservoir flows through; and a hollow and transparent shield disposed above the flow guiding mechanism, with the shield delimiting a space in communication with the channel and the outlet hole;

wherein the two half flow guiding mechanisms are in the first position for safe manual ignition for a user, wherein each of the two half flow guiding mechanisms includes a first base member and a second base member joined to the first base member, wherein the first base member has a first engaging end and the second base member has a second engaging end engaging with the first engaging end, wherein the first engaging end forms a plurality of first ridges each including first and second edges and an apex defined therebetween and the second engaging end forms a plurality of second ridges each including third and fourth edges and an apex defined therebetween respectively, wherein the first and second edges of one of the plurality of first ridges correspondingly face the third and fourth edges of one of the plurality of second ridges, wherein the first and second edges of the one of the plurality of first ridges have an included angle of greater than 90 degrees, and wherein the third and fourth edges of the one of the plurality of second ridges have an included angle of greater than 90 degrees.

2. The vortex flame device as claimed in claim 1, wherein each of the plurality of vanes has a first extension secured between the first edge of the one of the plurality of first ridges and the third edge of the one of the plurality of second ridges and a second extension extending from the first extension, wherein the spiral air passage between the two adjacent vanes of the plurality of vanes is delimited by the second extensions thereof, and wherein each of the plurality of vanes includes the second extension extending from the first extension obliquely, with the first and second extensions having an included angle of greater than 90 degrees.

3. A vortex flame device capable of being manually ignited safely comprising:

a flow guiding mechanism integrated from two half flow guiding mechanisms and with which a fuel reservoir is adapted to connect, with each half flow guiding mechanism including a wall, with the walls of the two half flow guiding mechanisms engaged together in a manner movable relative to each other, with each wall including a plurality of vanes mounted thereon, with the plurality of vanes disposed one after another along a circumference of a channel, with the two half flow guiding mechanisms jointly delimiting the channel, with two adjacent vanes of the plurality of vanes including a spiral air passage formed therebetween and in communication with the channel, with the two half flow guiding mechanisms selectively changing to a first position including a gap between free ends thereof and a second position with the free ends thereof joined;

a combustion head disposed in the channel and having at least one outlet hole that fuel of the connected fuel reservoir flows through; and a hollow and transparent shield disposed above the flow guiding mechanism, with the shield delimiting a space in communication with the channel and the outlet hole;

wherein the two half flow guiding mechanisms are in the first position for safe manual ignition for a user, and wherein the walls of the two half flow guiding mechanisms are pivotally engaged with each other.

4. The vortex flame device as claimed in claim 3 further comprising a lock mechanism engaging between the walls of the two half flow guiding mechanisms, with the lock mechanism in a first position where the walls of the two half flow guiding mechanisms are movable relative to each other and a second position where the walls of the two half flow guiding mechanisms are not movable with respect to each other.

5. A vortex flame device capable of being manually ignited safely comprising:

a flow guiding mechanism integrated from two half flow guiding mechanisms and with which a fuel reservoir is adapted to connect, with each half flow guiding mechanism including a wall, with the walls of the two half flow guiding mechanisms engaged together in a manner movable relative to each other, with each wall including a plurality of vanes mounted thereon, with the plurality of vanes disposed one after another along a circumference of a channel, with the two half flow guiding mechanisms jointly delimiting the channel, with two adjacent vanes of the plurality of vanes including a spiral air passage formed therebetween and in communication with the channel, with the two half flow guiding mechanisms selectively changing to a first position including a gap between free ends thereof and a second position with the free ends thereof joined;

a combustion head disposed in the channel and having at least one outlet hole that fuel of the connected fuel reservoir flows through;

a hollow and transparent shield disposed above the flow guiding mechanism, with the shield delimiting a space in communication with the channel and the outlet hole, wherein the two half flow guiding mechanisms are in the first position for safe manual ignition for a user; and a lock mechanism engaging between the walls of the two half flow guiding mechanisms, with the lock mechanism in a first position where the walls of the two half flow guiding mechanisms are movable relative to each other and a second position where the walls of the two half flow guiding mechanisms are not movable with respect to each other, wherein the lock mechanism includes a hole in one of the two half flow guiding mechanisms and a detent mounted on the other of the two half flow guiding mechanisms, with the locking mechanism in the first position including the detent including a catch retained in the hole, with the locking mechanism in the second position including the catch disengaged from the hole, wherein the catch is engaged with and biased by a biasing member, wherein the lock mechanism includes a housing receiving the catch and the biasing member, and wherein the biasing member has one end abutted against the catch and another end abutted against the housing.

6. The vortex flame device as claimed in claim 3, wherein each of the two half flow guiding mechanisms includes a pedestal bearing an end of the wall, wherein the pedestal includes a base and a plurality of support columns disposed on the base, and wherein two adjacent support columns of the plurality of support columns include an ventilation region in between.

7. The vortex flame device as claimed in claim 6, wherein one of the two half flow guiding mechanisms includes the base of the pedestal defining a first embedding area and another of the two half flow guiding mechanisms includes the base of the pedestal defining a second embedding area respectively, and wherein the two half flow guiding mechanisms in the second position include the first and second embedding areas embedded with each other.

8. The vortex flame device as claimed in claim 7, wherein the first embedding area defines an extension and the second embedding area defines a recess.

9. The vortex flame device as claimed in claim 6, wherein one of the two half flow guiding mechanisms includes the base of the pedestal including a through hole receiving and allowing insertion of a connecting head of the connected fuel reservoir.

10. The vortex flame device as claimed in claim 3, wherein the combustion head defines a receiving end delimiting a hollow area and includes an adapter for connecting with a connecting head of the connected fuel reservoir extending in the hollow area of the receiving end, wherein the adapter includes a cavity in which the connecting head of the connected fuel reservoir is received and a bore in fluid communication with the hollow area, wherein the outlet hole is in fluid communication with the cavity, and wherein the cavity and the bore extend through the adapter, with the cavity delimited by a periphery of the adapter, and with the bore extending through the periphery of the adapter.

11. The vortex flame device as claimed in claim 10, wherein the receiving end of the combustion head defines a first peripheral edge on one of the two half flow guiding mechanisms and a second peripheral edge on another of the two half flow guiding mechanisms.

12. The vortex flame device as claimed in claim 1, wherein the combustion head includes first and second plugs.

13. The vortex flame device as claimed in claim 3, wherein the combustion head includes first and second plugs.

* * * * *